US005404707A

United States Patent [19]

Suzuki

[11] Patent Number: 5,404,707

[45] Date of Patent: Apr. 11, 1995

[54] FASTENING ELEMENT

[76] Inventor: Masakatsu Suzuki, 10-8, 1-chome, Koyata, Iruma-shi, Saitama-ken, Japan

[21] Appl. No.: 192,747

[22] Filed: Feb. 7, 1994

Related U.S. Application Data

[63] Continuation-in-part of Ser. No. 843,888, Jan. 31, 1992, abandoned.

[30] Foreign Application Priority Data

Jan. 31, 1991 [JP] Japan ..... 3-010784

[51] Int. Cl.[6] ..... B21G 7/02

[52] U.S. Cl. ..... 59/71; 59/75; 59/77

[58] Field of Search ..... 59/71, 75, 77, 30, 335.1, 59/72, 73, 76, 8; 72/352, 359, 463; 470/121

[56] References Cited

U.S. PATENT DOCUMENTS

| | | | |
|---|---|---|---|
| 1,346,507 | 7/1920 | Muller | 59/35.1 |
| 1,437,918 | 12/1922 | Smith | 59/71 |
| 1,727,574 | 9/1929 | Tibbals | 59/77 |
| 2,343,933 | 3/1944 | Saul | 59/77 |
| 2,351,608 | 6/1944 | Greenwood | 59/77 |
| 3,109,187 | 11/1963 | Pirc | 470/121 |
| 3,410,127 | 11/1968 | Burns | 72/359 |
| 3,940,844 | 3/1976 | Colby et al. | 59/77 |
| 4,037,403 | 7/1977 | Lanz et al. | 59/35.1 |

FOREIGN PATENT DOCUMENTS

| | | |
|---|---|---|
| 110996 | 5/1899 | Germany . |
| 514092 | 1/1938 | United Kingdom . |
| 855647 | 12/1960 | United Kingdom . |
| 1364159 | 8/1974 | United Kingdom . |

*Primary Examiner*—David Jones
*Attorney, Agent, or Firm*—Paul A. Guss

[57] ABSTRACT

A fastening element is constructed from a first bar-shaped member (12), wherein a second bar-shaped member (14*a* ) and a third bar-shaped member (14*b* ) extend in parallel along a direction normal to the axial direction of the first bar-shaped member (12). The first bar-shaped member (12) has respective ends in which flat or bent slanted portions (18*a*, 18*b* ) are formed. The first bar-shaped member is formed additionally with first and second ribs (20*a*, 20*b* ) which extend outwardly beyond respective connecting positions between the first bar-shaped member and the second and third bar-shaped members (14*a*, 14*b*. ) The fastening element is formed from a U-shaped member which is positioned in a main die (36 ) such that a bent portion of the U-shaped body (40 ), corresponding to the first bar-shaped member, is positioned above the an upper surface of the main die, and wherein respective ends of the legs of the U-shaped body, corresponding to the second and third bar-shaped members, contact an auxiliary die (38 ) disposed beneath the main die. A pressing die is forcibly lowered into contact with the U-shaped member for forcing respective sides thereof outwardly to form the first and second ribs. At a time after pressing commences but before the upper pressing die has completed pressing the first bar-shaped member, the auxiliary die is lowered thereby allowing the second and third bar-shaped members to yield while the first bar-shaped member is being pressed.

1 Claim, 4 Drawing Sheets

PRIOR ART

FASTENING ELEMENT

This is a continuation-in-part of U.S. application Ser. No. 07/843,888, filed Jan. 31, 1992, now abandoned.

BACKGROUND OF THE INVENTION

Filed of the Invention

The present invention relates to a fastening element and to a method for making a fastening element, and more specifically to a fastening element and method of making a fastening element having increased rigidity and increased strength in response to tensile forces. Furthermore, according to the method of the present invention, the fastening element is made in such a manner as to eliminate the formation of cracks and other weaknesses in the fastening element during fabrication.

Description of the Related Art

A fastening element has been known which is suitable for use as a locking device for a vehicle door, as well as for a link end of a conveyor chain, for example. The locking device comprises an engagement pawl disposed on the door side and a fastening element disposed on a vehicle body side. The engagement pawl is moved into a space defined by the fastening element under a locking operation, and is formed of a metallic material having a hook capable of being moved into or away from the space. On the other hand, the fastening element is formed of a metallic material having a U-shaped configuration and is fixed to the vehicle body through a center pole thereof.

Since the fastening element has a U-shaped configuration as described above, the engagement pawl is simply brought into contact or engagement with one point at the top of an engagement portion of the fastening element when a fastening operation of the fastening element is made. Thus, when the fastening element is continuously used over a long period of time, undesirable metal fatigue is concentratively induced at the contacted points of the fastening element as a result of the load imposed by the vehicle door. As a result, cracks are produced, thus causing a problem that the locked or fastened state between the engagement pawl and the fastening element cannot be ensured, thereby increasing the danger of the vehicle door becoming opened while the vehicle is running, especially when lateral loads are applied to the vehicle door while the vehicle is turning around a curve.

A metal heading machine for forming a metal head connecting two bolt sections, or legs, of a U-shaped shackle is known from U.S. Pat. No. 1,437,918. In this apparatus, a cylindrical metal rod having respective threaded ends is initially bent about a mandrel into a U-shaped blank. The legs of the U-shaped blank are then rigidly bound between the mandrel and respective lateral dies which are moved into engagement with the mandrel. While the legs of the U-shaped blank are rigidly bound in this fashion, a punch abruptly strikes the rounded portion of the U-shaped blank while the blank remains rigidly held in the dies. When the rounded portion of the U-shaped blank is abruptly struck by the punch, the rounded portion is forced outwardly to form ribs which extend beyond the position of the legs of the U-shaped blank, thereby forming the head of the shackle.

The apparatus according to U.S. Pat. No. 1,437,918, however, possesses the following disadvantages. Because the legs of the U-shaped blank are rigidly bound between the mandrel and the dies when the blank is struck by the punch, the legs cannot yield when the rounded portion of the blank is impacted and abruptly struck by the punch. Such rigid clamping of the legs between the dies causes counteracting forces to develop which act in opposition to the direction of impact when the punch strikes the rounded portion of the blank. As shown in FIG. 4, it has been discovered that such an action frequently produces small cracks C and other imperfections at the joints between the legs 14*a*, 14*b* and head portion 12 of the shackle, which detrimentally weaken the shackle. Thus, the shackle produced by this apparatus cannot meet the needs of fastening element having high strength and structural integrity.

SUMMARY OF THE INVENTION

It is a principal object of the present invention to provide a fastening element which overcomes the aforementioned disadvantages, the fastening element being of a type wherein a portion thereof on which an engagement member is to be mounted can reliably be increased in size so as to reduce undesirable metal fatigue which tends to concentrate on one point of the mounting portion and wherein the strength of the fastening element can be increased by providing ribs thereon.

It is another object of the present invention to provide a fastening element comprising a first bar-shaped member, the fastening element further comprising a second bar-shaped member and a third bar-shaped member which extend in parallel to each other along a direction normal to the axial direction of the first bar-shaped member from positions near respective ends of the first bar-shaped member, the first bar-shaped member having first and second ribs which respectively extend outwardly from a connecting portion of the second bar-shaped member and a connecting portion of the third bar-shaped member, and wherein the first bar-shaped member, the second bar-shaped member, the third bar-shaped member and the first and second ribs are formed by bending a single member made of steel.

The fastening element of the present invention is constructed such that the second and third bar-shaped members extend in parallel to each other along a direction normal to the axial direction of the first bar-shaped member, and the first bar shaped member is used to support the engagement member. Accordingly, the portion of the fastening element subjected to stress can be decentralized, as compared with a conventional U-shaped fastening element, so that metal fatigue does not readily develop. In addition, the strength of the fastening element in response to tensile forces can be enhanced as a result of the ribs extending from both ends of the first bar-shaped member, wherein such ribs protrude, respectively, from the second and third bar-shaped members.

It is a still further object of the present invention to provide a process for forming a fastening element, the process including the steps of: providing a cylindrical steel stock; cutting a cylindrical piece of steel having a predetermined length from the steel stock; bending the cylindrical piece of steel to form a U-shaped body having a first bar-shaped member extending longitudinally along an axial direction, and second and third bar-shaped members extending in parallel to each other along a direction normal to the axial direction of the first bar-shaped member; positioning the U-shaped body in a main die such that the second and third bar-shaped members are oriented vertically downward of the first bar-shaped member, wherein the second and third bar shaped members extend through respective holes defined in the main die, and respective ends of the second and third bar-shaped members contact an auxiliary die disposed below the main die, such that the first bar-shaped member is positioned a predetermined distance above an upper surface of the main die thereby leaving a gap between the first bar-shaped member and the upper surface of the main die; pressing the first bar-shaped member forcibly downward with an upper pressing die, thereby flattening the first bar-shaped member while folding and forcing respective sides thereof outwardly along the axial direction of the first bar-shaped member to form first and second ribs extending outwardly beyond respective connecting positions between the first bar-shaped member and the second and third bar-shaped members; and, after pressing commences but before the upper pressing die has completed pressing the first bar-shaped member, lowering the auxiliary die thereby increasing the space within said holes, and allowing the second and third bar-shaped members to yield filling the increased space while the first bar-shaped member is being pressed.

As a result of the above-described process steps, the second and third bar-shaped members are permitted to yield during the time that the upper pressing die acts upon the first bar-shaped member of the U-shaped body. Accordingly, excessive counteracting forces are not developed as the first bar-shaped member is pressed downward, and as the respective sides of the first bar-shaped member are forced outwardly to form the ribs. Therefore, when the fastening element is fabricated by the process of the invention, cracks do not develop in the joints between the legs and the head of the formed fastening element, thereby producing a product having increased strength and high structural integrity.

DETAILED DESCRIPTION OF THE PREFERRED EMBODIMENTS

The fastening element of the present invention will hereinafter be described in detail with reference to the accompanying drawings in which a preferred embodiment is shown by way of illustrative example.

Figure 1:
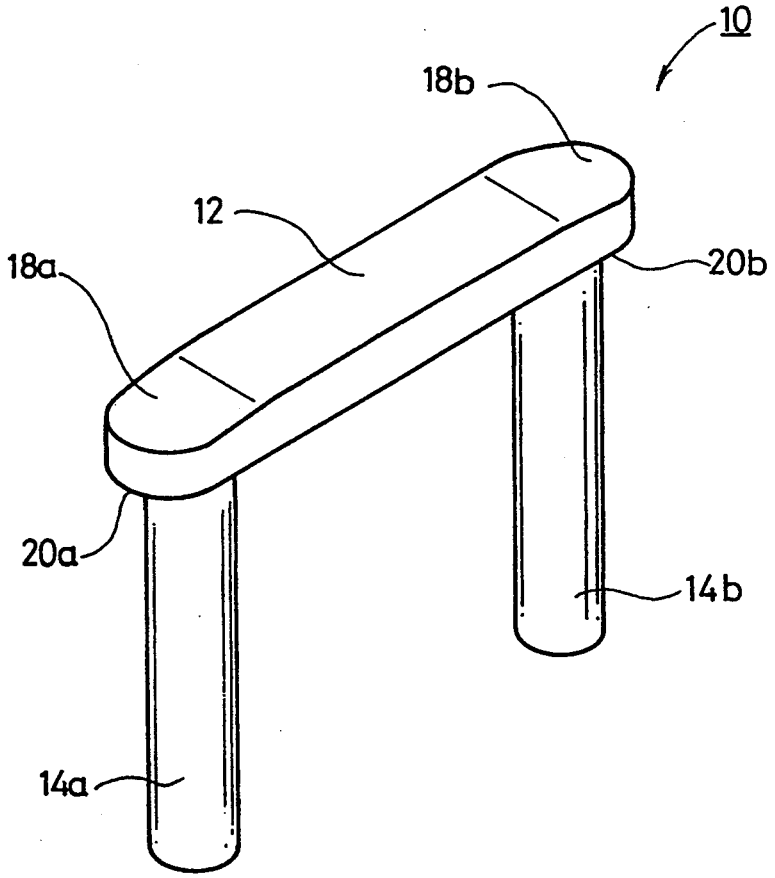
FIG. 1 is a perspective view of a fastening element of the present invention.

In FIG. 1, reference numeral 10 indicates the fastening element according to the present embodiment. The fastening element basically comprises a first bar-shaped member 12, a second bar-shaped member 14*a* and a third bar-shaped member 14*b*.

The first bar-shaped member 12 extends longitudinally along an axial direction and has flat or bent slanted portions 18*a*, 18*b* formed on both ends thereof.

In addition, the second bar-shaped member 14*a* and the third bar-shaped member 14b extend downwardly from the first bar-shaped member 12 in parallel with each other from positions near the respective ends of the first bar-shaped member 12. The first bar-shaped member 12 is formed with a first rib 20*a* and a second rib 20*b* which project outwardly from the second bar-shaped member 14*a* and the third bar-shaped member 14*b*.

The fastening element 10 is fabricated in the following manner.

Figure 2:
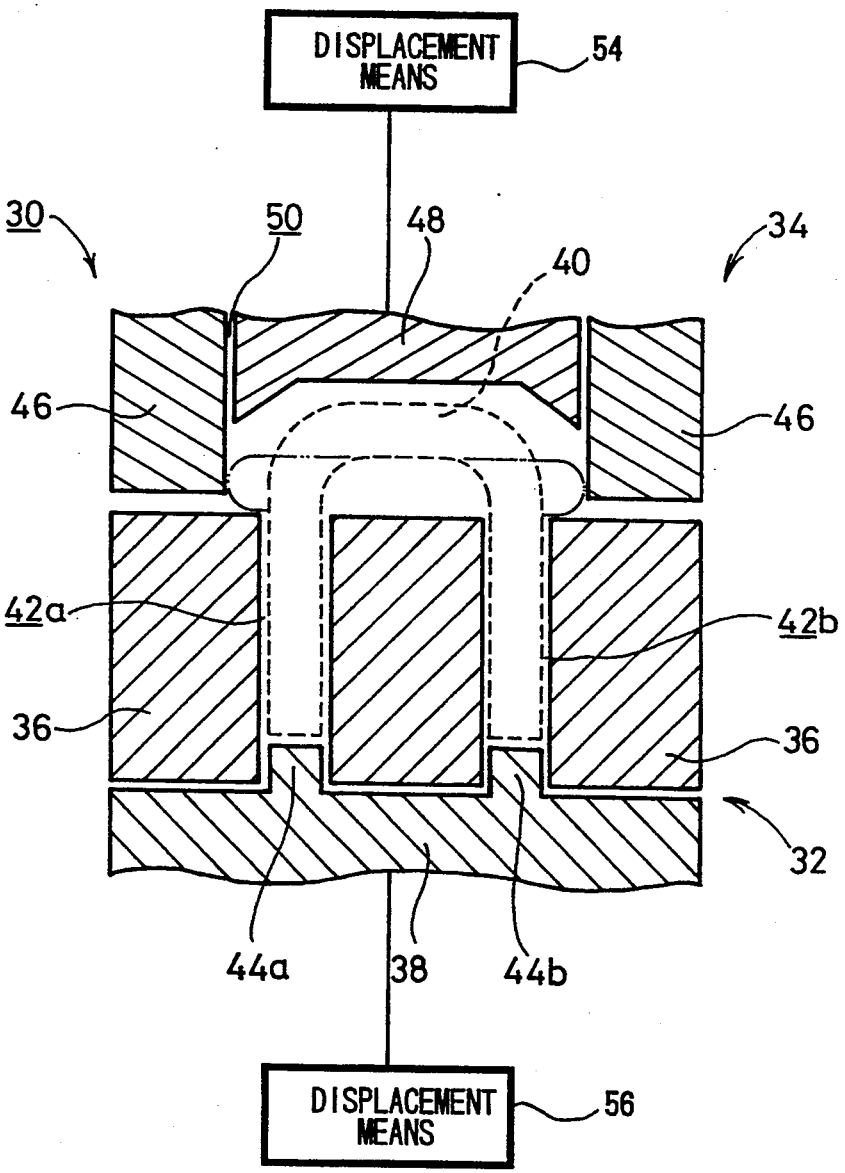
FIG. 2 is a vertical cross-sectional view of a rib forming device for fabricating the fastening element.

Initially, a cylindrically shaped member made of steel having a predetermined diameter and a circular cross-section is cut to a predetermined length by an unillustrated cutting device. The steel member may comprise a chromium-molybdenum steel, for example. Thereafter, the member thus cut is bent in the form of a U-shaped frame by an unillustrated bending apparatus. Then, a rib forming device, as shown in FIG. 2, is used to form the fastening element 10 according to the present embodiment. More specifically, the rib forming device comprises a lower mold 32 and an upper mold 34. The lower mold includes a cylindrical main die 36 and a cylindrical auxiliary die 38. The main die 36 has two holes 42*a*, 42*b* defined therein along an axial direction thereof in such a manner that a member 40 made of steel and bent in the form of a U-shaped frame by the bending apparatus can be inserted in the holes 42*a*, 42*b*, and wherein each of the holes 42*a*, 42*b* has a given diameter. The auxiliary die is disposed below the main die 36 and has protrusions 44*a*, 44*b* inserted in the corresponding holes 42*a*, 42*b* defined in the main die 36. A lower displacement means 56, for example a hydraulic cylinder or other suitable actuator, is coupled to a lower portion of the auxiliary die 38, for positioning the auxiliary die at a position beneath the main die 36, and also for lowering or releasing the auxiliary die downwardly from the main die, as shall be discussed in further detail hereinbelow.

The upper mold 34 includes a cylindrical restricting die 46 and a pressing die 48. The restricting die 46 has a rectangular hole 50 defined therein. The dimension of the hole 50, which extends in the horizontal direction, as viewed in the drawing, is longer than the longest distance extending between the holes 42*a*, 42*b* defined in the main die 36. The pressing die 48 has a lower surface wherein both sides thereof may be slanted downwardly, as shown, and wherein the pressing die is movably inserted in the rectangular hole 50. An upper displacement means 54, for example a hydraulic cylinder or other actuator, is coupled to an upper portion of the pressing die 48 for forcibly lowering the pressing die through the rectangular hole 50 and into contact with the bent portion of the U-shaped body, as discussed in further detail hereinbelow.

To form the fastening element, the auxiliary die 38 is first placed into position and firmly supported at a location below the main die 36 such that the protrusions 44*a*, 44*b* extend into the holes 42*a*, 42*b* of the main die. Thereafter, the second bar-shaped member 14*a* and the third bar-shaped member 14*b* of the steel U-shaped member 40 are inserted respectively in the corresponding holes 42*a*, 42*b* of the main die 36 so as to be brought into abutment with the corresponding protrusions 44*a*, 44*b*. At this time, the bent portion of the U-shaped member 40 is positioned so that the portion corresponding to the first bar-shaped member 12, i.e. the bent portion of the U-shaped member, is supported above the upper surface of the main die 36.

The restricting die 46 is then brought into contact with the upper surface of the main die 36 and fixedly mounted thereon. Thereafter, the upper displacement means 54 is activated to cause the pressing die 48 to be displaced toward the main die 36. A pressing force is therefore gradually applied to the steel member 40 as the lower surface of the pressing die 48 is brought into abutment with the bent portion of the U-shaped member 40, thereby forming a flat portion in the center of the U-shaped member 40. In addition, both sides of the member 40 are forced outwardly from the holes 42*a*, 42*b* of the main die 36 so as to form the first and second ribs 20*a*, 20*b*.

At a time after the upper displacement means 54 has begun displacing the pressing die 48 toward the main die, preferably as the pressing die approaches its lowermost position but before the pressing die has fully completed its downward stroke, the auxiliary die 38 is also displaced downwardly, or released, away from the main die 36 by the lower displacement means 56. By lowering or releasing the auxiliary die in this fashion, the space within the holes 42*a*, 42*b* increases. The second and third bar-shaped members (i.e. the legs) of the U-shaped body are thus permitted to yield downward, filling the increased space as the ribs of the fastening element are being formed, and before intense pressures can develop due to the downward movement of the pressing die. Therefore, abrupt counteracting forces which might otherwise occur are avoided, and undue strains on the U-shaped body which could produce cracks and other imperfections in the fastening element, particularly at points proximate the ribs where the second and third bar-shaped members join together with the first bar-shaped member, are prevented.

The upper displacement means 54 is then operated to cause the upper mold 34 to be separated from the lower mold 32, thereby allowing the formed fastening element 10 to be removed from the die.

Figure 3:
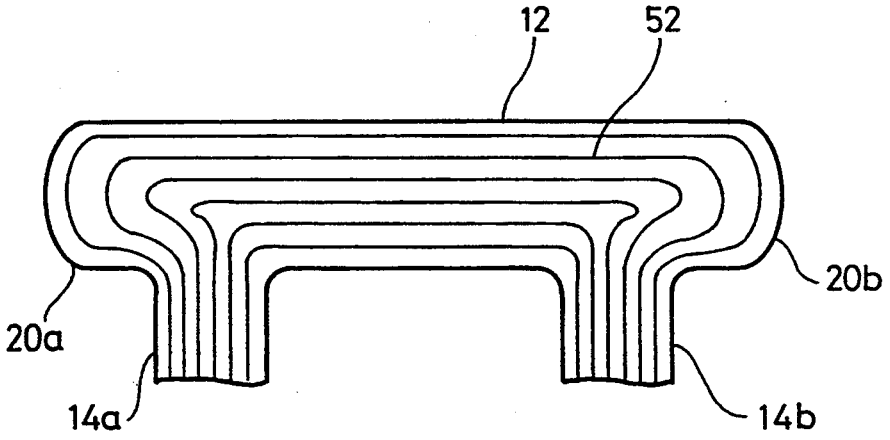
FIG. 3 is a partial sectional view of the fastening element, made from a steel compound, and a vertical cross-sectional view schematically showing a surface of the fastening element produced by the rib forming device.

FIG. 3 is a vertical cross-sectional view showing, in a bent state, the steel member 40, which is produced by the rib forming device 30 and constitutes the fastening element 10 of the present invention. More specifically, the compositional structure of the material making up the bar-shaped member 12, as illustrated by laminar or fiber-like contours 52 in FIG. 3, is configured in such a manner as to be bent toward the first and second ribs 20*a*, 20*b* substantially at right angles in respective positions where the first bar-shaped member 12, the second bar-shaped member 14*a* and the third bar-shaped member 14*b* are folded. The compositional structure 52 exhibits angles which vary, i.e., which are curved and folded from the second bar-shaped member 14*a* and the third bar-shaped member 14*b*, respectively, and which are oriented toward the first and second ribs 20*a*, 20*b* which have been pressed outwardly by the pressing die 48 of the rib forming device 30. However, as the compositional structure 52 approaches the first and second ribs 20*a*, 20*b* it extends again in parallel with the first and second ribs 20*a*, 20*b*. An increase in the strength of the fastening element in response to tensile forces can be achieved due to the compositional configuration of the first and second ribs 20*a*, 20*b*, shown in FIG. 3.

Figure 4:
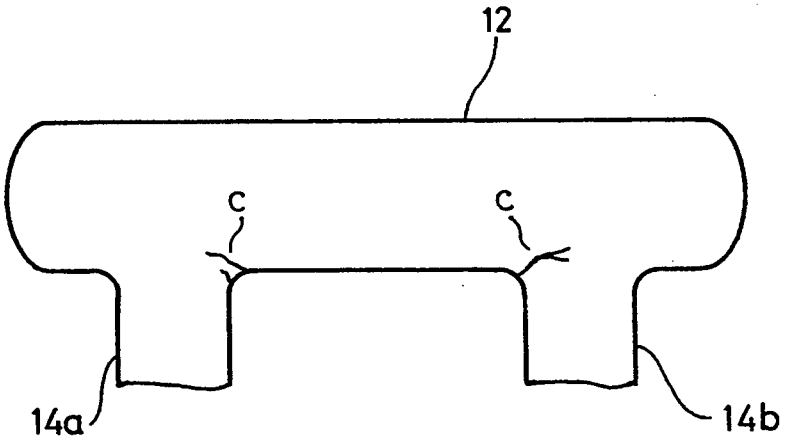
FIG. 4 is a fastening element, formed according to the teachings of the prior art.

Further, in comparison to the shackle shown in FIG. 4, the fastening element made according to the process of the present invention does not develop cracks or other imperfections therein at the points where the second and third bar-shaped members join with the first bar-shaped member. Accordingly, the fastening element has increased strength and high structural integrity.

The lower displacement means 56 is not limited to an actuator, but may also comprise means for resiliently attaching the auxiliary die 38 to the main die 36 is such a manner so as to permit the auxiliary die to give or yield downwardly somewhat as the U-shaped body is being pressed by the pressing die. Thereby, the second and third bar-shaped members 42*a*, 42*b* are also permitted to yield before intense pressures or abrupt counteracting forces develop which could cause cracks and other imperfections to occur.

It should be understood that the terms "upper," "lower," "downward," "below," etc. as used in the present specification and claims are terms of reference only with respect to the views shown in the accompanying figures, and that the particular orientation of the dies or the apparatus as a whole is not critical to the operation of the invention.

Incidentally, the fastening device 10 may be manufactured by using a warm forging method or a hot press forging method. In addition, the use of the fastening element of the present invention is not necessarily limited to a locking device for a vehicle door. The fastening element may also be used as a master link for connecting together a terminating portion and a starting portion of a chain used for transmission of a rotational force. In this case, a tautly-fastened device may additionally be fixed to the free ends of the second bar-shaped member and the third bar-shaped member.

The first bar-shaped member extends in an axial direction, and the second and third bar-shaped members extend in parallel with each other from respective ends of the first bar-shaped member. An engagement member can thus be supported by the first bar-shaped member, whereby stress is no longer concentrated on a single point and hence metal fatigue does not readily develop. Further, the strength of the fastening element in response to tensile forces can be enhanced owing to the existence of the ribs.

According to the process of the present invention, because the lower displacement means permits the auxiliary die to move away from the main die as the first bar-shaped member is pressed and as the pressing die nears its lowermost position, the second and third bar-shaped members are allowed to yield, and abrupt counteracting forces which might otherwise produce strains on the U-shaped body are prevented. Accordingly, detrimental cracks and other imperfections in the completed product are avoided.

What is claimed is:

1. A process for forming a fastening element, comprising the steps of:

providing a cylindrical steel stock;

cutting a cylindrical piece of steel having a predetermined length from said steel stock;

bending said cylindrical piece of steel to form a U-shaped body having a first bar-shaped member extending longitudinally along an axial direction, and second and third bar-shaped members extending in parallel to each other along a direction normal to the axial direction of said first bar-shaped member;

positioning said U-shaped body in a main die such that said second and third bar-shaped members are oriented vertically downward of said first bar-shaped member, wherein said second and third bar shaped members extend through respective holes defined in said main die and respective ends of said second and third bar-shaped members contact an auxiliary die disposed below said main die, such that said first bar-shaped member is disposed a predetermined distance above an upper surface of said main die thereby leaving a gap between said first bar-shaped member and said upper surface of said main die;

pressing said first bar-shaped member forcibly downward with an upper pressing die, thereby flattening said first bar-shaped member while folding and forcing respective sides thereof outwardly along the axial direction of said first bar-shaped member to form first and second ribs extending outwardly beyond respective connecting positions between said first bar-shaped member and said second and third bar-shaped members; and, after pressing commences but before said upper pressing die has completed pressing said first bar-shaped member, lowering said auxiliary die thereby allowing said second and third bar-shaped members to yield while the first bar-shaped member is being pressed.

* * * * *